US007650085B2

(12) United States Patent
Kehoe et al.

(10) Patent No.: US 7,650,085 B2
(45) Date of Patent: Jan. 19, 2010

(54) AUTOMATED DETECTION AND NOTIFICATION OF THE NEED FOR SERVICE AND/OR SUPPLIES REPLENISHMENT IN A MACHINE

(75) Inventors: Michael P. Kehoe, Rochester, NY (US); Tracy E. Thieret, Webster, NY (US); Robert J. St. Jacques, Fairport, NY (US); Michael R. Furst, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 406 days.

(21) Appl. No.: 11/495,323

(22) Filed: Jul. 27, 2006

(65) Prior Publication Data

US 2008/0025734 A1 Jan. 31, 2008

(51) Int. Cl.
*G03G 15/00* (2006.01)
*G03G 15/08* (2006.01)

(52) U.S. Cl. ..... 399/8; 399/10; 399/11; 399/24; 399/27

(58) Field of Classification Search ..... 399/8, 399/24, 25, 33, 27, 10, 11
See application file for complete search history.

(56) References Cited

U.S. PATENT DOCUMENTS 5,077,582 A 12/1991 Kravette et al.
5,305,199 A 4/1994 LoBiondo et al.
5,659,837 A * 8/1997 Jo ..... 399/25
6,016,409 A 1/2000 Beard et al.
6,023,593 A 2/2000 Tomidokoro
6,173,128 B1 1/2001 Saber et al.
6,529,692 B1 3/2003 Haines et al.
6,798,997 B1 9/2004 Hayward et al.
6,914,696 B1 * 7/2005 Kojima et al. ..... 399/24
7,181,147 B2 * 2/2007 Kinoshita et al. ..... 399/27
2004/0234281 A1 * 11/2004 Yoshida et al. ..... 399/24
2006/0034627 A1 * 2/2006 Kikuchi et al. ..... 399/24
2006/0283933 A1 * 12/2006 Ueda et al.
2007/0036564 A1 * 2/2007 Pytlik ..... 399/27

FOREIGN PATENT DOCUMENTS

JP 03219264 A * 9/1991
JP 08308005 A * 11/1996
JP 2004240110 A * 8/2004
JP 2007-017754 * 1/2007

* cited by examiner

*Primary Examiner*—Susan S Lee
(74) *Attorney, Agent, or Firm*—Wiggin and Dana LLP

(57) ABSTRACT

A system for automatically detecting the need to service a machine. The system includes a processor and at least one of a device component and a supply component. The processor determines a time at which the device component will require repair or replacement and when the supply component will need replenishment and sends an electronic message addressed to a communication device accessible by the user or supplier. The electronic message includes data which facilitates ordering services and sending the supplies to the user of the machine.

32 Claims, 4 Drawing Sheets

AUTOMATED DETECTION AND NOTIFICATION OF THE NEED FOR SERVICE AND/OR SUPPLIES REPLENISHMENT IN A MACHINE

BACKGROUND

Print devices such as laser printers, copiers and the like create documents and other marked media that use large quantities of consumable supplies such as paper sheets, transparencies and toner, for example. These supplies must be replenished periodically as they are consumed by the printing or copying process. If these supplies are allowed to run out without replacement for prolonged periods, the printing devices cannot produce marked media output which uses the supplies. In order to minimize user downtime that may result from supplies running out periodically during use of the printing device, it has become the practice to keep an excess of supplies on hand at the device site for use in the printing or copying process. Although this practice is more convenient for the user operationally, it does have a number of significant disadvantages. For example, the current means of estimating consumption of the supplies by the user, which must be ascertained before any excess of supplies can be determined, is in many cases inaccurate and unreliable. Furthermore, supplies designated as excess by the supplier and allocated by the user for one machine are often used in other machines that are not part of the program. This of course results in higher operating costs to both the user and supplier.

In addition to replenishing consumable supplies such as paper sheets, toner and the like, printing devices and other similar machines frequently require periodic service including maintenance and replacement of worn parts. Various systems have been developed for indicating when a device component of a machine needs service or when the device itself is reaching the end of its useful life. However, such systems have also proven to be ineffective and unreliable. To overcome these limitations and disadvantages, various methods for detecting the need for service and/or to replenish supplies for machines such as printing devices have been devised.

U.S. Pat. No. 6,798,997 to Hayward, et al., which is incorporated by reference herein in its entirety, is directed to an automatic supply ordering system for electronically ordering a consumable component or replaceable part in a marking machine. The system provides electronic identification of a condition of a replaceable component and automatically electronically sends an offer to purchase a replacement part upon identification of a threshold condition.

U.S. Pat. No. 6,529,692 to Haines, et al., which is incorporated by reference herein in its entirety, is directed to a consumable order assistance system for a computer peripheral device that includes: a computer peripheral device, a personal computer, a user interface, and a communication link. The computer peripheral device has a consumable requiring periodic replenishment. The personal computer is signal coupled with the peripheral device. The user interface is provided on one of the computer peripheral device and the personal computer, and is operative to notify a user of a state of the consumable. The communication link signal couples the personal computer with a provider of the consumable for the peripheral device. The personal computer is operative to monitor the computer peripheral device to determine the state of the consumable, and to notify a user via the user interface of a need to replenish the consumable.

U.S. Pat. No. 6,173,128 to Saber et al., which is incorporated by reference herein in its entirety, is directed to an electrophotographic printing or copying machine includes a functional module which can be readily removed and replaced. The module includes a monitor in the form of an electronically-readable memory, which includes information about how the particular module is to be operated. In a remanufacturing process, certain combinations of codes in the memory are noted to determine whether individual parts in the module should be replaced.

U.S. Pat. No. 6,023,593 to Tomidokoro, which is incorporated by reference herein in its entirety, is directed to a consumable item supplying system that includes a plurality of image forming apparatuses each using a plurality of consumable items, for example, copysheets, toner, and so on. The consumable item supplying system includes a consumable item manual requesting operation for manually requesting a consumable item from each of the image forming apparatuses. A central controller orders a consumable item from a consumable item supplier or the like when the consumable item is requested from one of the image forming apparatuses, and a data communication device can receive data representing a consumable item request by polling each of the image forming apparatuses and sending the polling results from the image forming apparatus to the central controller.

U.S. Pat. No. 6,016,409 to Beard et al., which is incorporated by reference herein in its entirety, describes status messages at which a machine will display or otherwise communicate the approach of a need to replace a module. These status messages are determined by the machine extrapolating the average daily print volume, and when a particular threshold number of days to module replacement is reached, an appropriate status message is communicated by the machine, either to an end user through a display or directly to a service provider over a network. For example, the machine can communicate a "reorder module" message at some point between 10 and 25 days (the exact day being set by user preference, or as a result of particular service plan code) before the expected end of life of the module; a "prepare to replace" message at some point between 2 and 5 days; a "replace today" message at 1-2 days; and finally a "hard stop" message when the module runs out.

U.S. Pat. No. 5,305,199 to LoBiondo, et al., which is incorporated by reference herein in its entirety, is directed to a reprographic machine that includes an inventory tracking system for monitoring consumable supplies. Usage data from a plurality of networked reprographic machines is supplied to a single tracking system for monitoring inventories of supplies consumed by the network. Automatic or semi-automatic ordering can be provided via a remote interactive communication system. Order confirmation, projected shipment dates and shipment confirmations can be provided from the reorder site. The system can provide inventory monitoring customized to a local network.

U.S. Pat. No. 5,077,582 to Kravette, et al., which is incorporated by reference herein in its entirety, is directed to a system for monitoring a variable output paper processing device. The monitoring system includes a counter which counts the number of papers processed and provides a count signal for each counted paper. A controller receives the count signals and totals the counts. The controller transmits the total count to a central station through a modem after either a predetermined time or a predetermined count. Internal diagnostic signals in the printing device are intercepted as they are transmitted to an internal display device of the printing device and transmitted to the central computer through the modem.

BRIEF SUMMARY

According to one aspect, there is provided a system for automatically detecting the need for services in a machine, wherein the services include at least one of repair or replacement of a device and/or replenishment of supplies, and notifying the service provider or supplier that such services are needed. The system includes a processor and at least one other component, which may be a device or a supply component. The device component may be any part of a machine that is subject to wear and/or replacement while the supply component may be any consumable item that is used by the machine. The processor automatically determines if the device component needs service, including repair or replacement, and/or if the supply component is low or nearly exhausted. The processor automatically sends an electronic message addressed to a remote communications device, notifying the provider or supplier that services are required. The electronic message includes data relative to the type of services needed and facilitates providing the services to the user of the machine.

According to another aspect, there is provided a method for automatically detecting the need for services in a machine, wherein the services include at least one of repair or replacement of a device and/or replenishment of supplies, comprising providing a processor in the machine, storing data in the processor indicating past usage of a device and/or supply component, monitoring the current condition of the device and/or supply component, extrapolating the monitored current condition against the stored past usage data to estimate a time at which the machine will require services, transmitting a signal from the processor to a remote communication device notifying the provider or supplier that services will be needed at the estimated time and then facilitating providing the services to the user of the machine.

According to yet another aspect, there is provided a machine comprising at least one device or supply component and a processor, the processor including means for detecting the current condition of the component, means for storing data indicative of past usage of the component, means for extrapolating the current condition of the component against the past usage of the component to determine an estimated time at which the component will need service, and means for transmitting a signal to a remote communications device notifying a service provider of the estimated time at which services for the machine will be required.

BRIEF DESCRIPTION OF THE DRAWING

Referring now to the figures, which are exemplary embodiments, wherein like items are numbered alike.

DETAILED DESCRIPTION

Figure 1:
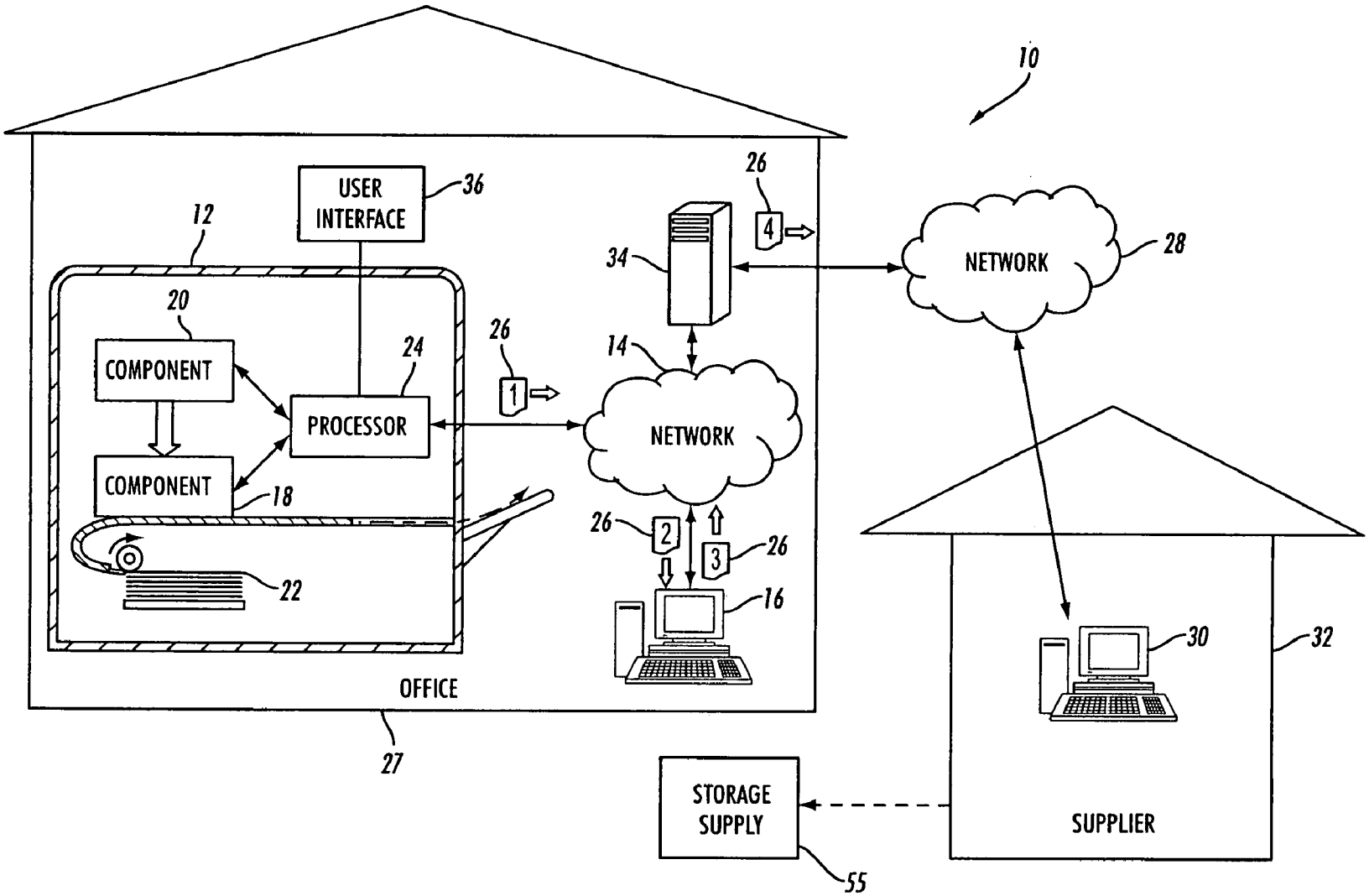
FIG. 1 is a schematic view of a system for automatically detecting the need for services in a machine and for notifying a service provider of the estimated time at which services will be required.

FIG. 1 is a schematic depiction of a system 10 for automatically detecting the need for services in a machine, wherein services include the repair and replacement of device components and replenishment of supply components, and for notifying the user of the machine when such services will be required. The system 10 includes the machine 12, which may be a printing apparatus, for example, a local communications network 14 and, optionally, a local communication device 16, such as a computer. The machine 12 includes at least one device component 18, supply components 20, 22, and at least one processor 24. The processor 24 is configured to determine the condition of the device component 18 and/or one or more of the supply components 20, 22. The device component 18 may be any device or part of the machine that is subject to wear and/or replacement, such as a marking device or fuser roller, both of which may be customer replaceable, the supply component 20 may be any consumable item, such as toner, fuser oil, and staples, while the supply component 22 may be sheet media such as blank paper or transparencies, or continuous feed (roll) media, for example. As will be described in further detail hereinafter, the processor 24 sends an electronic message 26, via the local network 14 and a remote communications networks 28, to a communications device 30 located at the service provider or supplier 32, which message involves the condition of the device component 18 and/or one or both of the supply components 20, 22.

As used herein, a local communication device is any device coupled to the machine 12 by at least one computer communications network. The local communication device 16 is optional and fulfills the function of an auxiliary or backup system. It may include any one or more: personal computer, workstation computer, laptop computer, handheld computer, palmtop computer, cellular telephone, personal digital assistant (PDA), and any other device capable of communicating electronic messages via the local network 14. It is contemplated that the local communication device 16 is associated with a user who is responsible for manually ordering supplies for the machine 12 in the event that the automated system disclosed herein is temporarily taken off line for service or otherwise rendered inoperable. The network 14 may be, for example, a Local Area Network (LAN) associated with an office 27, building, campus, or other limited geographic space.

The supplier computer 30 may include any one or more: personal computer, workstation computer, laptop computer, mainframe computer, and other computers capable of receiving data from multiple customers via network 28. The remote communications network 28 may include any one or more of: a Wide Area Network (e.g., the Internet, an Intranet, and the like), a telephone network, and the like. Either network 14 or 28 may employ any wired and/or wireless mode of communication. In general, network topologies other than those shown in FIG. 1 may be employed.

In the embodiment shown, the electronic message 26 is sent to the remote communication device 30 at the supplier 32 via the local communications network 14 using an electronic messaging service provided by a message server computer (message server) 34 associated with the communications network 14. The message server 34 includes any one or more computers having: components that handle the transfer of messages to and from other message servers and user computers, a storage area where electronic messages are stored for users of the messaging service, and a set of rules that determine how the message server computer 34 should react to messages and commands from the processor 24 and optionally the user via the communication device 16. While the message server 34 is shown as being associated with the local network 14 (e.g., forming part of the LAN), it will be appreciated that message servers may be associated with the remote network 28 (e.g., the Internet) and may be accessed by the machine 12 and/or optionally by the communication device 16 via the remote network 28.

The message server 34 may provide any suitable electronic messaging service to send the electronic message 26 from the machine 12 to the provider or supplier computer 30. As used herein, an electronic message is any electronic, file, data, or other information transmitted between computers, servers, processors, terminals, and the like within a computer network. Well-known electronic messaging services include: electronic mail (e-mail), text messaging, instant messaging, Short Messaging Service (SMS), and the like.

For example, the message server 34 may be an e-mail server and the electronic message 26 sent from the machine 12 to the remote communication device 30 via network 28 may be an e-mail message. In this embodiment, the processor 24, message server 34, and supplier computer 30, as well as optionally computer 16, may employ one or more protocols found in the Transport Control Protocol/Internet Protocol (TCP/IP) suite of protocols to communicate the electronic message 26. The most common TCP/IP protocols used for e-mail are SMTP (Simple Mail Transfer Protocol), Post Office Protocol (POP), and Internet Message Access Protocol (IMAP). In general, SMTP is used in sending and receiving e-mail, while POP and IMAP let the computer 30 (optionally computer 16) and processor 24 save messages in a mailbox in message server 34 and download them periodically from the message server 34. Other protocols that can be employed and which might be preferred include web services over HTTP and HTTPS which are wire protocols, similar to the use of SMTP for email. The MIME (Multipurpose Internet Mail Extensions) protocol may also be used to send binary data across networks 14 and 28. The processor 24, message server 34, and computer 30 may employ a commercially available e-mail program to send and receive the message 26. Commercially available e-mail programs include, for example, Lotus Notes, Microsoft Outlook and Netscape Communicator.

In another example, instant messaging may be used to provide the electronic message 26 to the remote communication device 30 via network 28. Popular instant messaging services on the Internet include MSN (Microsoft Network) Messenger, AOL (America On Line) Instant Messenger, Yahoo! Messenger, and Internet Relay Chat (IRC). In yet another example, text messaging or SMS may be used to provide the electronic message 26 to the communication device 30. Text messaging and SMS are generally applied to send relatively short text messages (e.g., about 160 alphanumeric characters or less) to and from mobile devices (e.g., a mobile phone) and/or IP addresses.

In the embodiment of FIG. 1, the machine 12 is depicted as a printing machine, such as a digital printer of the ink jet or "laser" (electrophotographic or xerographic) variety, or a digital or analog copier. The component 18 is depicted as a hardware device, such as a marking device or fuser rolls, for example, which are subject to wear and replacement during operation of the machine 12. The components 20, 22 are depicted as consumable supplies related to printing, such as toner or fuser oil and sheet media for the stack 22, respectively. It is contemplated, however, that the machine 12 may be any electrical, electronic, mechanical or electromechanical device, the component 18 may be any device or part that is subject to wear and replacement and the components 20, 22 may be any supply or material that is consumed by the machine 12. It will, of course, be understood that once the condition of the components 18, 20 or 22 has been detected, they can be repaired, replaced or replenished, as the case may be, by either the user, service provider or supplier.

In the embodiment of FIG. 1, the processor 24 communicates with the components 18, 20 and 22 via separate data paths indicated, for example, by double-ended arrows in FIG. 1. Processor 24 also may communicate with a user through the user interface 36 and, optionally, through the local computer 16 via the network 14.

In operation, sheets on which images are to be printed are drawn from the stack 22 and move relative to the marking device 18 where the individual sheets are printed upon with desired images. The marking material for placing marks on various sheets by marking device 18 is provided by marking material supply 20. If machine 12 is an electrostatographic printer, marking material supply 20 may include a supply of toner, while marking device 18 includes any number of hardware items for the electrostatographic process, such as a photoreceptor or fusing device. In the well-known process of electrostatographic printing, the most common type of which is known as "xerography," a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate, such as paper from the stack 22, and the image affixed thereto to form a permanent record of the image.

In the ink-jet context, the marking material supply 20 includes a quantity of either liquid or solid ink, and may include, in the case of liquid inks, separate tanks for different primary-colored inks, while the marking device 18 includes a printhead, for example. In either the electrostatographic or ink-jet context, "marking material" can include other consumed items used in printing but not precisely used for marking, such as oil or cleaning fluid used in a fusing device.

In the current market for office equipment, for example, it is typically desirable that a component such as toner 20 is configured as a module that is readily replaceable by the end user, thus saving the expense of having a representative of the supplier visit the user. Also, there may be provided several different modules for marking material supply 20, such as in a full color printer. In general, there may simply be provided one or more supply components associated with the machine 12, and it is expected that, at times within the life of machine 12, one or more of these components will need to be replenished.

Figure 2:
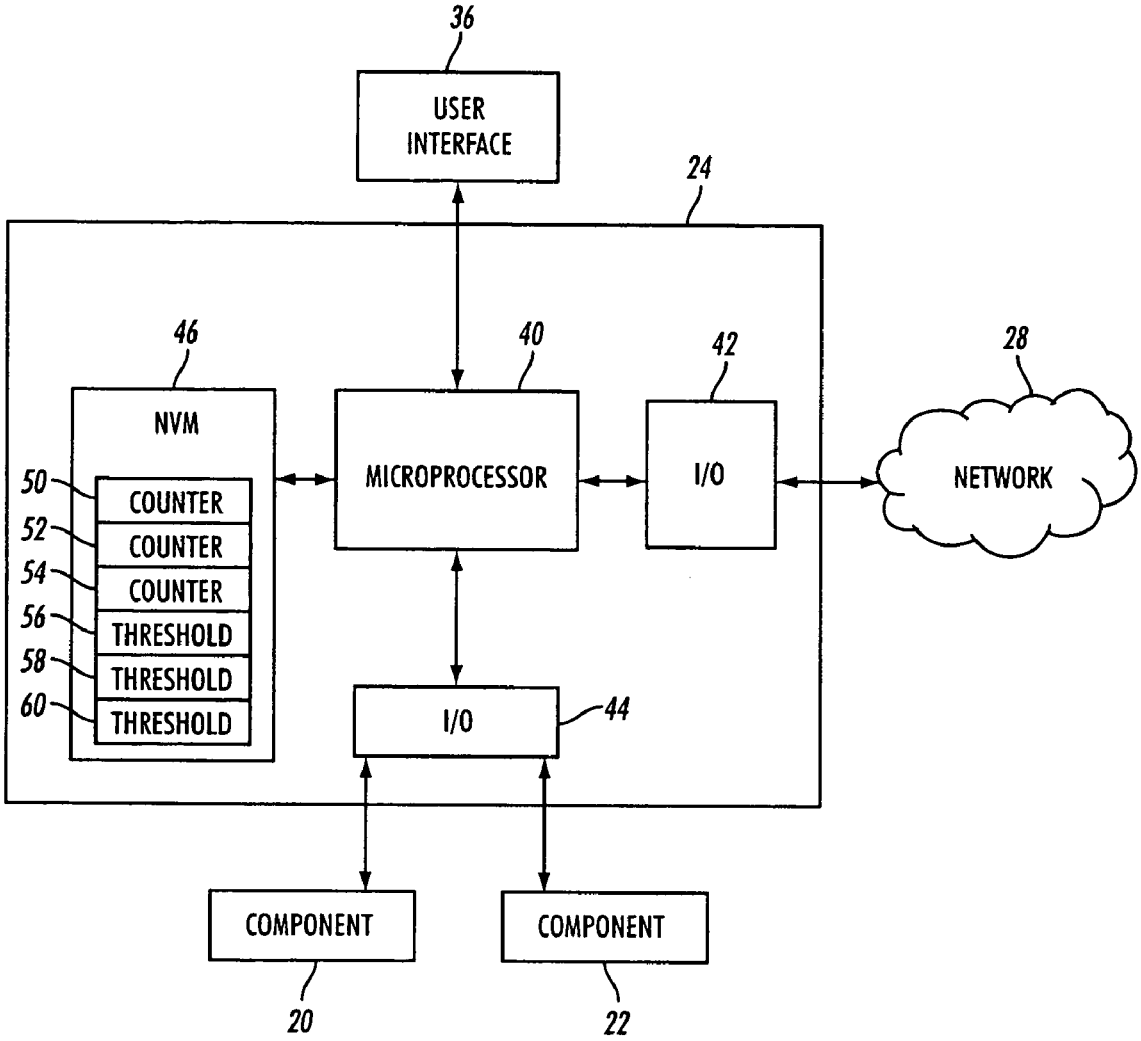
FIG. 2 is a similar view of a processor in the machine of FIG. 1.

FIG. 2 depicts an example of a processor 24 for use in the machine 12 of FIG. 1. The processor 24 includes a microprocessor 40 which may contain random access memory (RAM) for performing data calculations and manipulations and read only memory (ROM) for storing software to enable the various operations of the processor 24. Input information may be provided to the microprocessor 40 through the user interface 36 or through input/output (I/O) devices 42 and 44. I/O device 42 may be a network card for data coupling with network 14. I/O device 44 may be any device which amplifies, filters, or otherwise conditions or alters electronic signals to allow data communication between the microprocessor 40 and at least one of the device component 18 and supply components 20, 22. Coupled to the microprocessor 40 is a non-volatile memory device 46 (NVM), such as an electrically erasable programmable read-only memory (EEPROM), hard disk drive, or the like, that retains its contents when power to the processor 24 is turned off. While one example of processor 24 is shown, it is contemplated that processor 24 may comprise any number of microprocessors, printed wiring boards (PWBs), application specific integrated circuits (ASICS), data input/output devices (e.g., network interface cards), sensors, memory (e.g., Non-Volatile Memory (NVM), Read Only Memory (ROM), Random Access Memory (RAM)), and the like.

The microprocessor 40 is configured along with counters 50, 52 and 54 to detect a number of conditions or events that may occur during operation of the machine 12, such as when the machine is or will be out of a consumable supply or when a toner receptacle is filled, when a supply level is low and when a supply has been replenished and to what level it has been replenished. The usage counters 50, 52 and 54 may provide a count of the number of sheets of media output, or the number of pixels of colorant (toner) used in an image that has been printed or copied, for example.

As used herein, a condition of a component is any state of being of a component and may include: remaining or depleted supply of a consumable component, rate of depletion of a consumable component, age and health of a component, usage of a component, and wear and rate of wear of a component.

The processor 40 may implement counters 50, 52 and 54 for each component 18, 20 and 22 being tracked. In the example shown in FIG. 2, counters 50, 52 and 54 are implemented in the non-volatile memory device (NVM) 46. It is contemplated, however, that the counters 50, 52 and 54 may instead be implemented in hardware such as by use of mechanical counters or consumption gas gauge-like meters, for example.

The processor 24 is able to interpolate and analyze the data collected by the microprocessor 40 and counters 50, 52 and 54 and to provide an accurate estimation of the condition of all the components 18, 20 and 22. The processor 24 is also configured to implement a data model for the values of the supply levels that normalizes the values (i.e., provides a measure that is device independent and is relevant to the user's business processes), and/or puts the data in units that are most useable to the user. For example, rather than giving the number of grams of colorant used up so far in a toner bottle, the processor 24 provides data as a percentage of the toner bottle volume that remains to be used. The processor 24 is also able to determine by extrapolation based on recent usage, at which time in the future, the marking device 18 will have worn out and need replacement or when the toner supply 20 will likely be exhausted.

The processor 24 is also configured to create an event notification when any supply is estimated to have dropped below a predetermined, but configurable, level or when a device or part of the machine has reached or passed its useful life and needs to be replaced. This level or event may be dynamically configured to be a function of the device's historical usage and of the estimated arrival time for ordered replacement materials with an appropriate adjustment to accommodate any variation in the supply usage. An event notification may also be created by the processor 24 in the case where any device or part of the machine, based on past usage, is likely to break or wear out.

As indicated above, the supply level or predicted useful life data collected and analyzed by the processor 24 may be sent through the remote communication network 28, such as the internet, to a supplier or seller 32 of the supply being monitored, or may simply be displayed at the user interface 36, in which case, the user is responsible for rendering the necessary repairs or replenishing the supplies. In most cases, the supplies will have been stored locally by the user at a convenient place close to the machine 12 as depicted at 55 in FIG. 1. The supply level or predicted useful life data may be transmitted to the supplier 32 or displayed at the interface 36 at specified time intervals or may be converted to an event signifying that a part may be worn or a supply is low and may need to be re-ordered.

Figure 3:
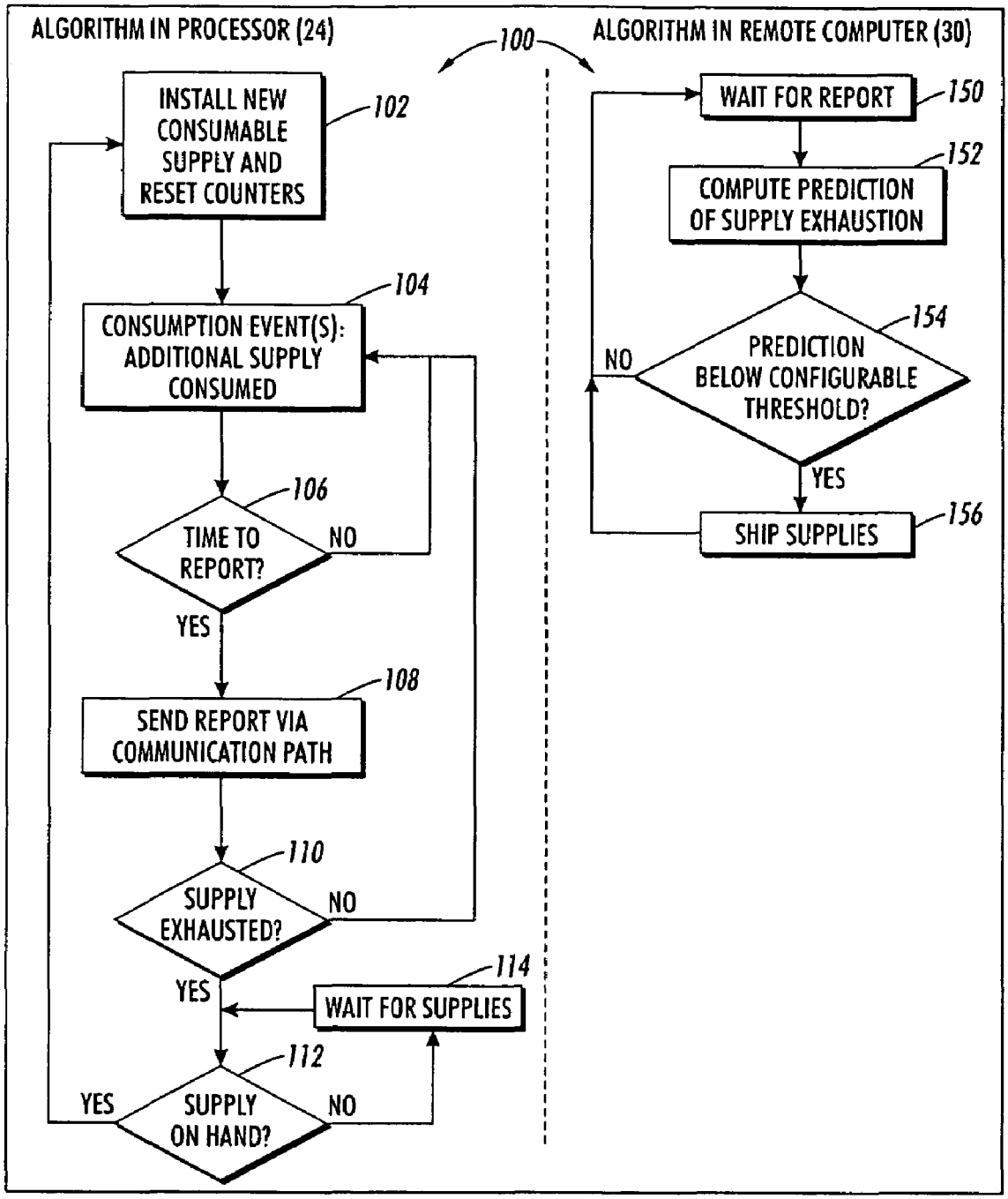
FIG. 3 is a flow chart depicting a method for automatically detecting the condition of a component in a machine and determining an estimated time at which the component will need service, based on condition or supply level reporting at configurable time intervals.

FIG. 3 depicts a flow chart of a method 100 for automatically detecting the need for services in a machine that may be employed by the processor 24. Method 100 is comprised of two algorithms; one starting at step 102 running in processor 24, and one starting at 150 that runs in remote computer 30. The method 100 is based on a supply level reporting system that is initiated at configurable time intervals, such as each time the machine 12 is started, and/or on an hourly, daily or weekly basis, for example, depending on how frequently the particular machine 12 is being used. The objective is to eliminate the wait for supplies in step 114 as will be described, while also minimizing the amount of supplies stored at storage supply 55 and the amount of time they are stored there.

The method 100 begins at step 102 where the processor 24 determines at start-up the condition of all the components 18, 20 and 22, e.g., age of a device component and remaining or depleted supply of a consumable component, for example.

The processor 24 may implement counters 50, 52, and 54 for each device and supply component 18, 20 and 22, respectively, being tracked and depending upon the condition of at least one of the components, the processor 24 may call for repair or replacement of a device or installation of additional consumables from a storage supply 55 to establish a fully stored level. After repair, replacement or installation is complete, the processor 24 resets the counters 50, 52 and 54 to correspond with this initial level.

During step 102, the microprocessor 50 sets an initial time interval, say one day, for example, during which time the machine 12 is allowed to operate and consume supplies before again determining the condition of components 18, 20 and 22 by implementing counters 50, 52 and 54. This time interval is determined by the processor 24 and its ability to extrapolate and analyze data collected from previous usage of the machine and to provide an estimation or prediction of when a device may be worn or the level of supplies may be low or exhausted.

The method 100 continues through step 104 with processor 24 tracking the time interval set in step 102. If the time interval has not yet expired, the method returns to its initial status at the beginning of step 104 and additional supplies are consumed. If, however, the time interval has expired, then the method advances to step 106, the processor 24 implementing counters 50, 52 and 54 for each component 18, 20 and 22 being tracked. The count value from each counter 50, 52 and 54 is indicative of the condition of the corresponding device or supply component 18, 20 and 22. The count provided by the counter 50 associated with marking device component 18 is indicative of the usage and remaining life of the component 18. The count provided by the counter 52 associated with the marking material component 20 is indicative of the amount of marking material (e.g., toner, ink, etc.) remaining in the module. The count provided by the counter 54 associated with the sheet media component 22 is indicative of the number of sheets used from, and remaining in, the stack 22. It will be appreciated that after the device component 18 has been repaired or replaced and/or additional supplies have been added to components 20, 22, the counter associated with each component is then reset.

In step 108, the processor 24 analyses the count data extracted from the counters 50, 52 and 54 and automatically prepares and sends an electronic message including the count data via the remote network 28 (e.g. the internet) to the remote computer 30 at the supplier 32. The same message is also concurrently sent to the user interface 36.

As indicated above, the remote computer 30 at the supplier 32 receives a message containing the count data from the counters 50, 52 and 54 that is sent by the processor 24. In step 150, the computer 30 waits for this report and, upon receipt, analyzes the data and, in step 152, computes a prediction, based on past usage, of when the repairs or replacement will be required or supplies will be exhausted. If this prediction is above a configurable threshold as determined by the computer 30 in step 154, then the method 100 at the supplier's site reverts back to step 150 and waits for another report from the processor 24. If, on the other hand, it is determined that the device component 18 will need repair or replacement and/or supply components 20, 22 will need to be replenished, or soon will be exhausted, then the supplier 32 in step 156 will automatically order the repairs, replacements or supplies, as the case may be, unless the supplier 30 has already ordered the repairs or replacements or shipped the supplies in response to a prior message from the processor 24. The threshhold can be configured in such a way that, under normal machine operation, the part or supply will arrive at the customer site before it is needed in machine 12.

If it is estimated in step 110, based on past usage, that no repair, replacement or additional supplies are required yet, the method 100 reverts back to step 104 and the process begins again. However, if it is determined in step 110 that the device component 18 needs repair or replacement or that supply components 20, 22 are exhausted, the microprocessor 40 initiates and transmits a signal to the interface 36, indicating the need to repair, replace or replenish. If there are sufficient parts or supplies on hand, then the component is repaired or replaced, the method 100 at step 112 reverts back to step 102 and the method starts over again. If, on the other hand, there are not enough parts or supplies at step 112, then, in this case, the user must wait for the proper parts or supplies to be repaired or at hand. It is this potential wait that this application seeks to eliminate or minimize.

Figure 4:
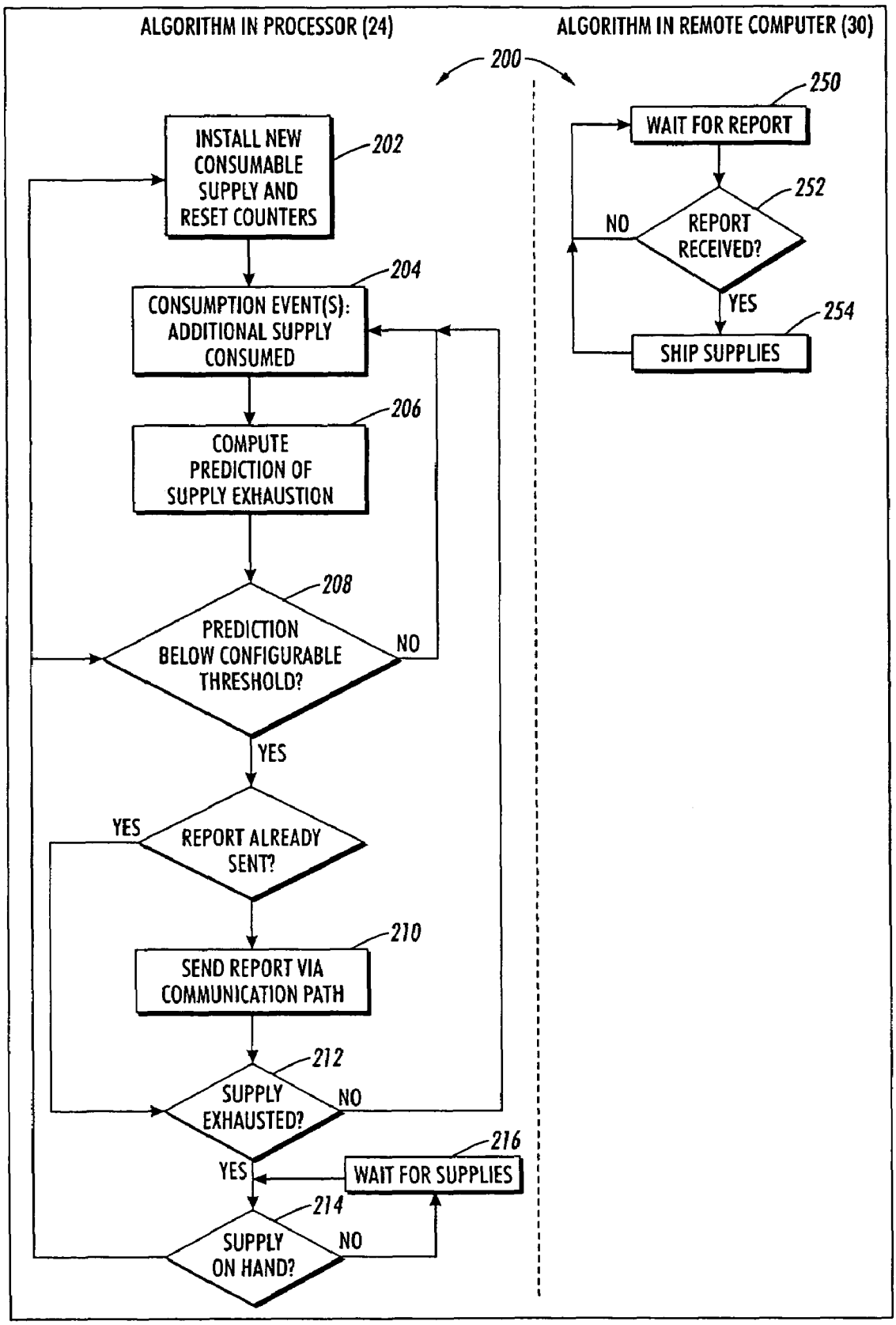
FIG. 4 is a flow chart depicting a similar method for automatically detecting the condition of a component in a machine and determining an estimated time for service, based on condition or supply level reporting at predetermined servicing events.

In FIG. 4, there is shown a flow chart for another method 200 for automatically detecting the need for services in a machine that may be employed by the processor 24. This method is similar to the method described hereinabove but is based on a supply level reporting system initiated by events instead of time intervals.

The method 200 begins at step 202 where the processor 24 determines at start-up the condition of the device component 18 and/or one or both of the supply components 20, 22 (e.g., the remaining or depleted supply of toner in the supply component 20, for example). The processor 24 may again implement counters 50, 52 and 54 for each device or supply component 18, 20 and 22, respectively, and depending upon the condition of the components, the processor 24 may call for the installation of additional consumables, (e.g. toner) to establish a fully stored level. After installing the consumables, the processor 24 resets the counters 50, 52 and 54 to correspond with the initial supply level.

The method 200 continues through step 204 with the processor 24 tracking the condition of the device component 18 and the amount of consumables in the components 20, 22 that are being consumed. At the same time, the processor 24 is continuously comparing the condition of each component 18, 20 and 22 against a threshold condition. As used herein, a threshold condition is a predetermined condition or value against which the condition being tracked is compared to determine a need to repair, replace or replenish a component.

The threshold condition for each component 18, 20 and 22 is established in step 206 based on past usage of the machine 12 and is stored as a corresponding threshold count value 56, 58 and 60 (FIG. 2) in the NVM 46. The microprocessor 40 compares the count value from each counter 50, 52 and 54 to the corresponding threshold count value 56, 58 and 60 to determine if the corresponding device or supply component will need to be repaired, replaced or replenished.

If in step 208, the microprocessor 40 determines that the condition of one of the components 18, 20 and 22 has not reached its corresponding threshold value, the method 200 returns to step 204 and the machine continues to consume supplies.

If, however, in step 208, the microprocessor 40 determines, based on past usage and/or configurable threshold values, that a condition of one of the device or supply components 18, 20 and 22 has in fact reached its threshold value (e.g., the count from either of the counters 50, 52, 54 has reached its associated threshold 56, 58, 60), and unless microprocessor 40 has already reported this threshold crossing to remote communication device 30, the method 200 proceeds to step 210 where the microprocessor 40 generates an electronic message or report including the count data and the need to repair or replenish certain supplies. This electronic message or report is sent to the provider or supplier 32 via the remote network 28 (e.g. the internet) to the remote communication device 30, e.g. the supplier's computer.

The provider or supplier's computer 30 waits to receive a message at step 250. Periodically, the computer 30 will query the system at step 252, seeking the message from the processor 24. If no message is received, then the computer 30 reverts back to a waiting mode at step 250 and the method 200 continues. However, when a message or report is received from the processor 24 indicating a lack of parts or exhaustion of supplies, the computer 30 at step 254 automatically orders the parts or supplies to be shipped to the user.

If it is estimated in step 212, based on past usage, that no repair, replacement or additional supplies are required yet, the method 200 reverts back to step 204 and the process begins again. However, if it is determined in step 212 that the device component 18 needs repair or replacement or that supply components 20, 22 are exhausted, the microprocessor 40 initiates and transmits a signal to the interface 36, indicating the need to repair, replace or replenish. If there are sufficient parts or supplies on hand, then the component is repaired or replaced, the method 200 at step 214 reverts back to step 202 and the method starts over again. If, on the other hand, there are not enough parts or supplies at step 214, then, in this case, the user must wait for the proper parts or supplies to be repaired or at hand. It is this potential wait that this application seeks to eliminate or minimize.

It will be appreciated that the above described system for detecting the need to service or replenish supplies in a machine is completely automatic and does not require the intervention of any human effort to determine the condition of a device or supply component or if and when a device will need to be repaired or replaced or a supply component will need to be replenished. With the present system, the user is able to keep fewer supplies on hand for less time, representing both a storage and cost savings. In some supply cases, like toner, there is less chance for degradation since the supplies spend less time in storage or on the shelf. Owners of the machine also bear lower human cost by not having to monitor supply levels and order supplies themselves.

It should be understood that any of the features, characteristics, alternatives or modifications described regarding a particular embodiment herein may also be applied, used, or incorporated with any other embodiment described herein.

A number of embodiments of the present system have been described. Nevertheless, it will be understood that various modifications may be made without departing from the spirit and scope of the invention.

What is claimed is:

1. A system for automatically detecting the need for services in a machine, comprising:

a processor;

at least one of a device component and supply component;

said processor including:

means for detecting a condition of said at least one of a device component and supply component, means for storing data indicative of past usage of said at least one of a device component and supply component, and means for determining a time for at least one of repair, replacement and replenishment of said at least one of a device component and supply component, based on extrapolation of said detected condition and said past usage data; and means for transmitting a report including said data indicative of past usage, wherein said means for detecting is configured to detect said condition in accordance with start-up of the machine said means for determining is configured to perform said extrapolation based on past usage over a time interval, said time interval configurable in accordance with expected frequency of use of the machine, and said means for transmitting is configured to transmit successive reports upon expiration of successive time intervals.

2. A system according to claim 1, further including a communication device accessible by at least one of a supplier or user of said machine.

3. A system according to claim 2, wherein said communication device is located at said machine.

4. A system according to claim 3, wherein said communication device is a user interface.

5. A system according to claim 1, further including a remote communication device associated with a service provider or supplier and a communication network coupling said machine with said remote communication device for transmitting a report indicative of said time for said at least one of repair, replacement or replenishment.

6. A system according to claim 5, wherein said remote communication device further includes means for receiving and interpreting said report sent from said machine and creating an order to at least one of ship said at least one of a device component and supply component for said machine, or to repair said device component for said machine and take no action, as appropriate.

7. A system according to claim 1, wherein said means for detecting the condition of said at least one of a device component and supply component includes at least one counter.

8. A system according to claim 7, wherein said counter is at least one of a unit counter and a level counter.

9. A system according to claim 8, wherein said unit counter is at least one of a mechanical counter and electronic counter.

10. A system according to claim 1, wherein said means for storing data includes at least one counter set to a predetermined value indicating a threshold.

11. A system according to claim 1, wherein said machine is a printer or copier.

12. A system according to claim 1, wherein said device component is a customer replaceable part selected from a marking device and fuser roller.

13. A system according to claim 1, wherein said supply component is one of toner, fuser oil, sheet media, transparencies, continuous feed roll media and staples.

14. A method for automatically detecting the need for service in a machine, comprising:

providing a processor in said machine;

monitoring a condition of at least one of a device component and a supply component in said machine;

storing data in said processor indicating past usage of said at least one of a device component and a supply component;

extrapolating said monitored condition and said past usage data to determine an estimated time at which said at least one of a device component and a supply component will need at least one of repair, replacement and replenishment; and transmitting a signal report including said data indicating past usage, wherein said monitoring is performed in accordance with start-up of the machine said extrapolating is performed based on past usage over a time interval, said time interval configurable in accordance with expected frequency of use of the machine, and said transmitting is performed upon expiration of successive time intervals.

15. A method according to claim 14, further comprising:

providing a communication device accessible by at least one of a supplier or user of said machine; and wherein said signal report is transmitted from said processor to said communication device indicating said estimated time for at least one of repair, replacement and replenishment.

16. A method according to claim 14, wherein said estimated time is determined by comparing a value of a usage counter against a value of a threshold counter.

17. A method according to claim 15, wherein said communication device is located at said machine.

18. A method according to claim 17, wherein said communication device is a user interface.

19. A method according to claim 15, wherein said communication device is a remote device located at a service provider or supplier.

20. A method according to claim 19, wherein said remote device communicates with said machine via a remote network.

21. A method according to claim 14, wherein said device component is a customer replaceable part.

22. A method according to claim 14, wherein said device component is one of a marking device and fuser roller.

23. A method according to claim 14, wherein said supply component is one of toner, fuser oil, sheet media, transparencies, continuous feed roll media and staples.

24. A method according to claim 15, wherein said communication device interprets the report sent from said machine and proceeds to at least one of creating an order to at least one of ship said at least one of a device component and supply component for said machine and repair said device component, and taking no action, as appropriate.

25. A method according to claim 14, wherein said machine is a printer or copier.

26. A machine comprising:

at least one of a device component and a supply component;

a processor said processor including, means for detecting a condition of said at least one of a device component and supply component;

means for storing data indicative of past usage of said at least one of a device component and a supply component;

means for determining a time for at least one of repair, replacement and replenishment of said at least one of a device component and supply component, based on extrapolation of said detected condition and said past usage data, and means for transmitting a signal to a remote communications device associated with a provider or supplier of said at least one device component and supply component, wherein said means for detecting is configured to detect said condition in accordance with start-up of the machine said means for determining is configured to perform said extrapolation based on past usage over a time interval, said time interval configurable in accordance with expected frequency of use of the machine, and said means for transmitting is configured to transmit successive reports upon expiration of successive time intervals.

27. A machine according to claim 26, further including means for creating an order to at least one of ship said at least one of a device component and supply component and repair said device component for said machine.

28. A machine according to claim 26, wherein said means for detecting the condition of said at least one of a device component and supply component includes at least one counter.

29. A machine according to claim 28, wherein said counter is at least one of a unit counter and a level counter.

30. A machine according to claim 29, wherein said unit counter is at least one of a mechanical counter and electronic counter.

31. A machine according to claim 26 wherein said means for storing data includes at least one counter set to a predetermined value indicating a threshold.

32. A machine according to claim 26 wherein said machine is a printer or copier.

* * * * *